US006234825B1

(12) United States Patent
Okabe

(10) Patent No.: US 6,234,825 B1
(45) **Date of Patent: *May 22, 2001**

(54) CONNECTOR LOCKING CONSTRUCTION

(75) Inventor: Toshiaki Okabe, Shizuoka (JP)

(73) Assignee: Yazaki Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/115,270

(22) Filed: Jul. 14, 1998

(30) Foreign Application Priority Data

Jul. 14, 1997 (JP) ..... 9-188628

(51) Int. Cl.[7] ..... H01R 13/627
(52) U.S. Cl. ..... 439/347; 439/352
(58) Field of Search ..... 439/347, 350–358, 439/488, 489

(56) References Cited

U.S. PATENT DOCUMENTS 4,634,204 * 1/1987 Detter et al. ..... 439/352
5,605,471 * 2/1997 Plyler ..... 439/352
5,628,648 * 5/1997 Higgins et al. ..... 439/352
5,720,623 * 2/1998 Polenick et al. ..... 439/352
5,820,398 * 10/1998 Stabroth et al. ..... 439/352

FOREIGN PATENT DOCUMENTS 62-176987 11/1987 (JP) ..... H01R/13/639
63-20378 2/1988 (JP) ..... H01R/13/639
5-1178 1/1993 (JP) ..... H01R/13/639

* cited by examiner

*Primary Examiner*—Hien Vu
(74) *Attorney, Agent, or Firm*—Sughrue, Mion, Zinn, Macpeak & Seas, PLLC

(57) ABSTRACT

Engagement projections 11 is formed on a male connector housing 10, and passage grooves 25 for respectively passing the engagement projections therethrough are formed in a hood portion 21 of a female connector housing 20, and the male connector housing is fitted into and removed from the hood portion, and a slide member 30, having elastic retaining projections 34 for engagement respectively with the engagement projections 11, is movably mounted on the hood portion 21 so that the slide member can be moved by pushing an operating portion 31 of the slide member, and a mutually-fitted condition of the two connector housings 10 and 20 is locked by the engagement of the elastic retaining projections 34 of the slide member 30 with the engagement projections 11 of the male connector housing 10. A guide groove 31*a* is formed in the operating portion 31 of the slide member 30, and an operating pushing force, applied to the operating portion 31, is supported at least by one surface 20*b* of the female connector housing 20 through the guide groove 31*a*.

6 Claims, 8 Drawing Sheets

CONNECTOR LOCKING CONSTRUCTION

BACKGROUND OF INVENTION

1. Field of the Invention

This invention relates to a connector locking construction in which a slide member, having elastic retaining projections, is mounted on a female connector housing, and by operating or moving the slide member, the locking of-a mutually-fitted condition of the two (female and male) connector housings, as well as the cancellation of the locking, can be effected.

2. Related Art

In a conventional construction for connecting a male connector 1, connected to a wire harness, to a female connector 5 connected to an equipment, a lock arm 3 is formed integrally on a male connector housing 2 made of a synthetic resin, and an engagement projection 7 for the lock arm 3 is formed integrally on a female connector housing 6, and the fitting connection between the two connectors 1 and 5 is locked by the lock arm 3 and the engagement projection 7.

Particularly, the equipment-side female connector housing 6 need to have thermal resistance, and therefore when a heat-resistant resin is used, the lock arm 3 of high elasticity, in many cases, can not be formed integrally on the female connector housing. Another problem, encountered when the lock arm 3 is formed on the equipment-side female connector housing 6, is that its operability, obtained when canceling the locked condition, is poor.

For these reasons, the lock arm 3, including a cancellation operation portion 4, has been formed on the wire harness-side male connector 1.

In the above conventional construction, however, the lock arm 3 projects from the male connector housing 2, and therefore the male connector 1 has an increased size, so that the whole of the connector is increased in size, and besides since the lock arm 3 is liable to interfere with other member, there is a possibility that the locked condition is accidentally canceled.

SUMMARY OF THE INVENTION

With the above problems in view, it is an object of this invention to provide a connector locking construction of a compact size in which an operating portion of a slide member, mounted on a female connector housing, can be smoothly operated, and the locking of a mutually-fitted condition of the two connector housings, as well as the cancellation of the locking, can be effected easily and positively.

According to the present invention, there is provided a connector locking construction wherein an engagement projection is formed on a male connector housing, and a passage groove for passing the engagement projection therethrough is formed in a hood portion of a female connector housing, and the male connector housing is fitted into and removed from the hood portion, and a slide member, having an elastic retaining projection for engagement with the engagement projection, is movably mounted on the hood portion so that the slide member can be moved by pushing an operating portion of the slide member, and a mutually-fitted condition of the two connector housings is locked by the engagement of the elastic retaining projection of the slide member with the engagement projection of the male connector housing; CHARACTERIZED in that a guide groove is formed in the operating portion of the slide member, and an operating pushing force, applied to the operating portion, is supported at least by one surface of the female connector housing through the guide groove.

In this connector locking construction, the slide member is smoothly moved without receiving a force tending to rotate the slide member, and the operability of the slide member is enhanced.

In the connector locking construction of the present invention, the guide groove has a channel-shape, and the channel-shaped guide groove is slid at least along an upper end surface of the female connector housing.

In this connector locking construction, the slide member is smoothly moved along the upper end surface of the female connector housing without rattling, and the operability of the slide member is enhanced.

In the connector locking construction of the present invention, a withdrawal-prevention retaining projection is provided at the guide groove in the operating portion.

In this connector locking construction, thanks to the provision of the withdrawal-prevention retaining projection, the slide member will not be disengaged from the upper end surface of the female connector housing.

In the connector locking construction of the present invention, the withdrawal-prevention retaining projection is inserted in a guide groove formed in the female connector housing in adjacent relation to the upper end surface of the female connector housing.

In this connector locking construction, the shaking of the slide member in rotational and other directions is positively prevented, and the slide member can be operated smoothly.

BRIEF DESCRIPTION OF THE DRAWINGS

FIG. 7(*b*) is a bottom view of the slide member;

DETAILED DESCRIPTION OF THE PREFERRED EMBODIMENTS

Figure 1:
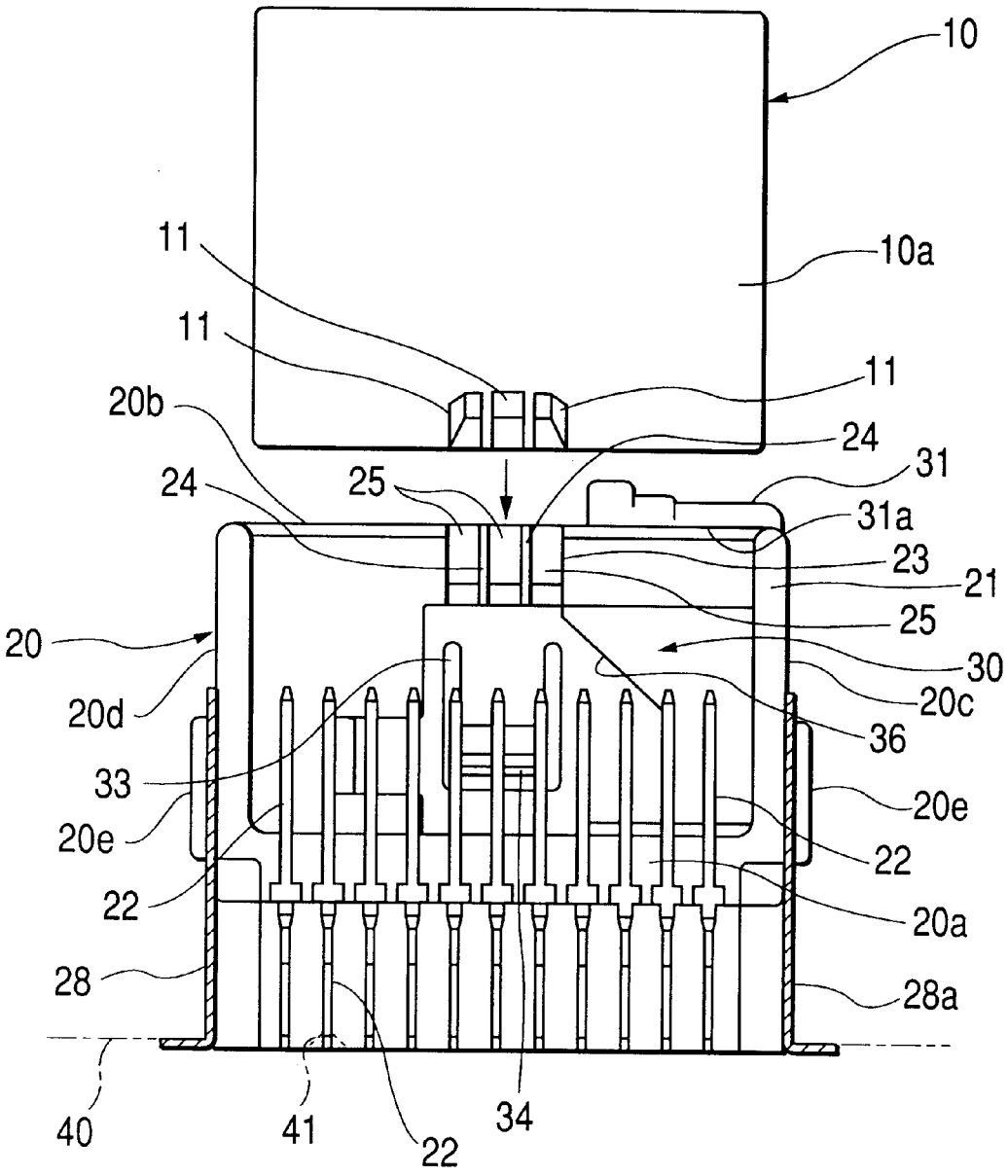
FIG. 1 is a view of a preferred embodiment of a connector locking construction of the present invention, showing a condition before female and male connector housings are fitted together.

A preferred embodiment of the present invention will now be described with reference to the drawings.

FIGS. 1 to 10 show one preferred embodiment of a connector locking construction of the present invention.

In this construction, engagement projections 11 are formed on a wire harness-side male connector housing 10, and passage grooves 25, through which the engagement projections 11 can pass, respectively, are formed in a hood portion 21 of a equipment-side (board-side) female connector housing 20. The male connector housing 10 can be fitted into and removed from the hood portion 21. A slide member 30, having elastic retaining projections 34 for engagement respectively with the engagement projections 11, is movably mounted on the hood portion 21, and this slide member 30 can be moved by pushing an operating portion 31.

A mutually-fitted condition of the two connector housings 10 and 20 is locked by the engagement of the elastic retaining projections 34 of the slide member 30 with the engagement projections 11 of the male connector housing 10.

Figure 6A:
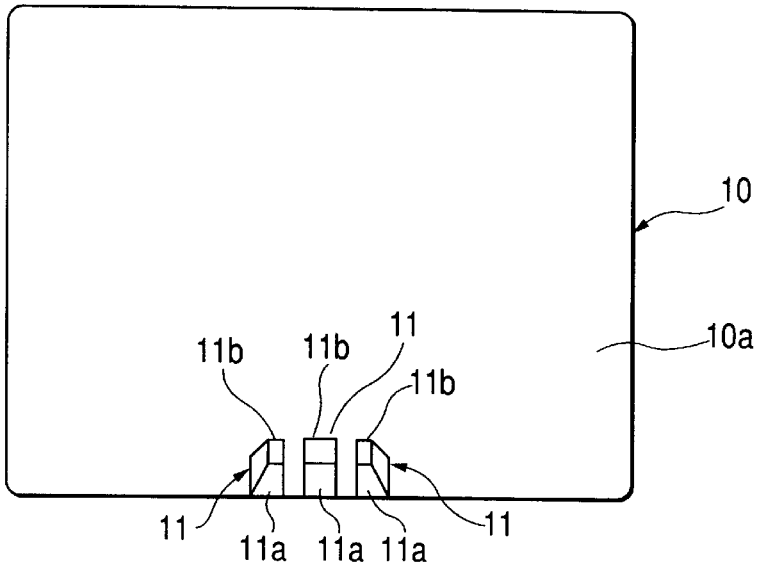
FIGS. 6(*a*), 6(*b*) and 6(*c*) are a plan view, a front-elevational view and a side-elevational view of the male connector housing, respectively.
Figure 6B:
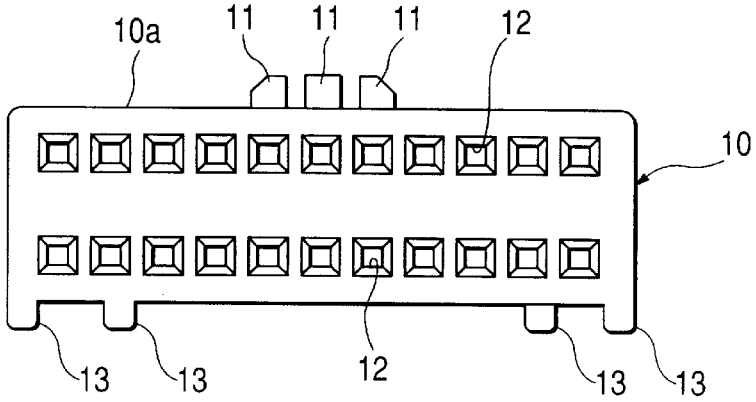
Figure 6C:
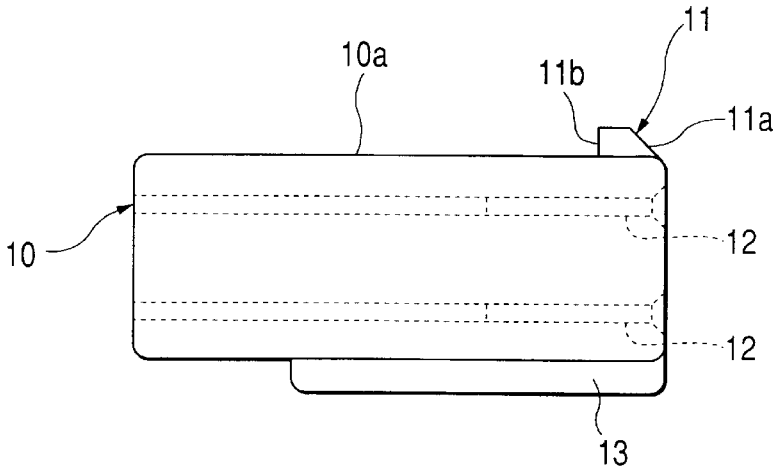

As shown in FIGS. 6(*a*), 6(*b*) and 6(*c*), the male connector housing 10 is made of a synthetic resin, and is formed into a block-like shape. The three engagement projections 11 are formed integrally on an upper surface 10*a* of this housing 10 at a central portion of a front portion thereof, and are arranged at equal intervals. A front surface of each engagement projection 11 is formed into a slanting surface 11*a,* and a rear surface thereof is formed into a slanting surface 11*b* close to a plane perpendicular to the upper surface 10*a*. A rear outer corner portion of each of the right and left engagement projections 11 is notched or removed.

As shown in FIGS. 6(*a*), 6(*b*) and 6(*c*), a plurality of terminal receiving chambers 12 are formed in two (upper and lower) rows in the male connector housing 10, and female terminals (not shown) are received in these terminal receiving chambers 12, respectively.

Wires (not shown), constituting a wire harness, are connected to these female terminals, respectively. A pair of legs 13 and 13 are integrally formed on and project from each of opposite side portions of a bottom surface of the male connector housing 10.

As shown in FIGS. 1 to 5, the female connector housing 20 is made of a synthetic resin, and the hood portion 21 of a square, tubular shape, is formed at a front portion of the female connector housing 20. A plurality of male tab terminals 22 are press-fitted in a proximal end portion 20*a* of the female connector housing 20, and project into the interior of the hood portion 21. A recess 23 is formed in a central portion of an upper wall of the hood portion 21 which is to be opposed to the three engagement projections 11. Two guide ribs 24 are formed in the recess 23, and the three passage grooves 25 for respectively passing the engagement projections 11 therethrough are formed by the recess 23 and the guide ribs 24. A pair of guide grooves 26 and 26 for respectively receiving the associated legs 13 and 13 (formed on the bottom surface of the male connector housing 10) are formed in each of opposite side portions of a lower wall of the hood portion 21.

Figure 2:
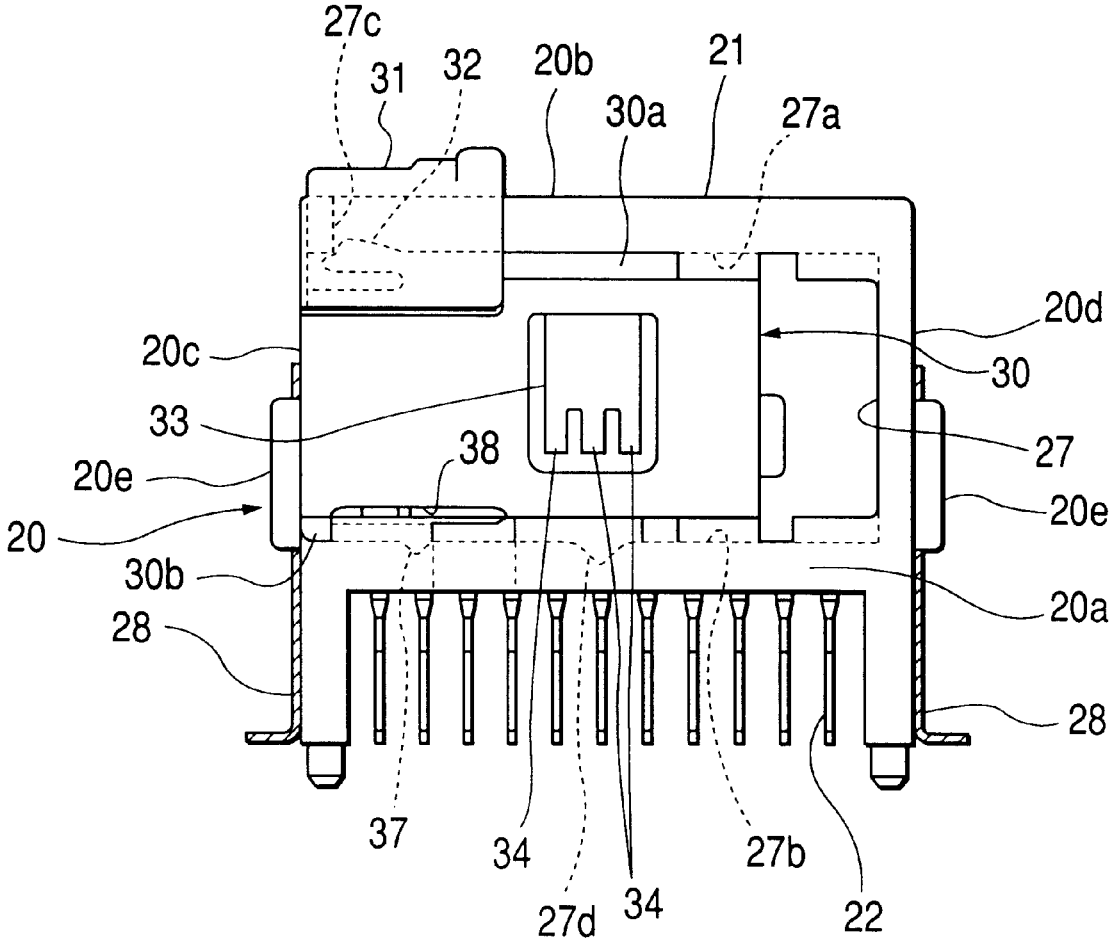
FIG. 2 is a plan view of the female connector housing.
Figure 3:
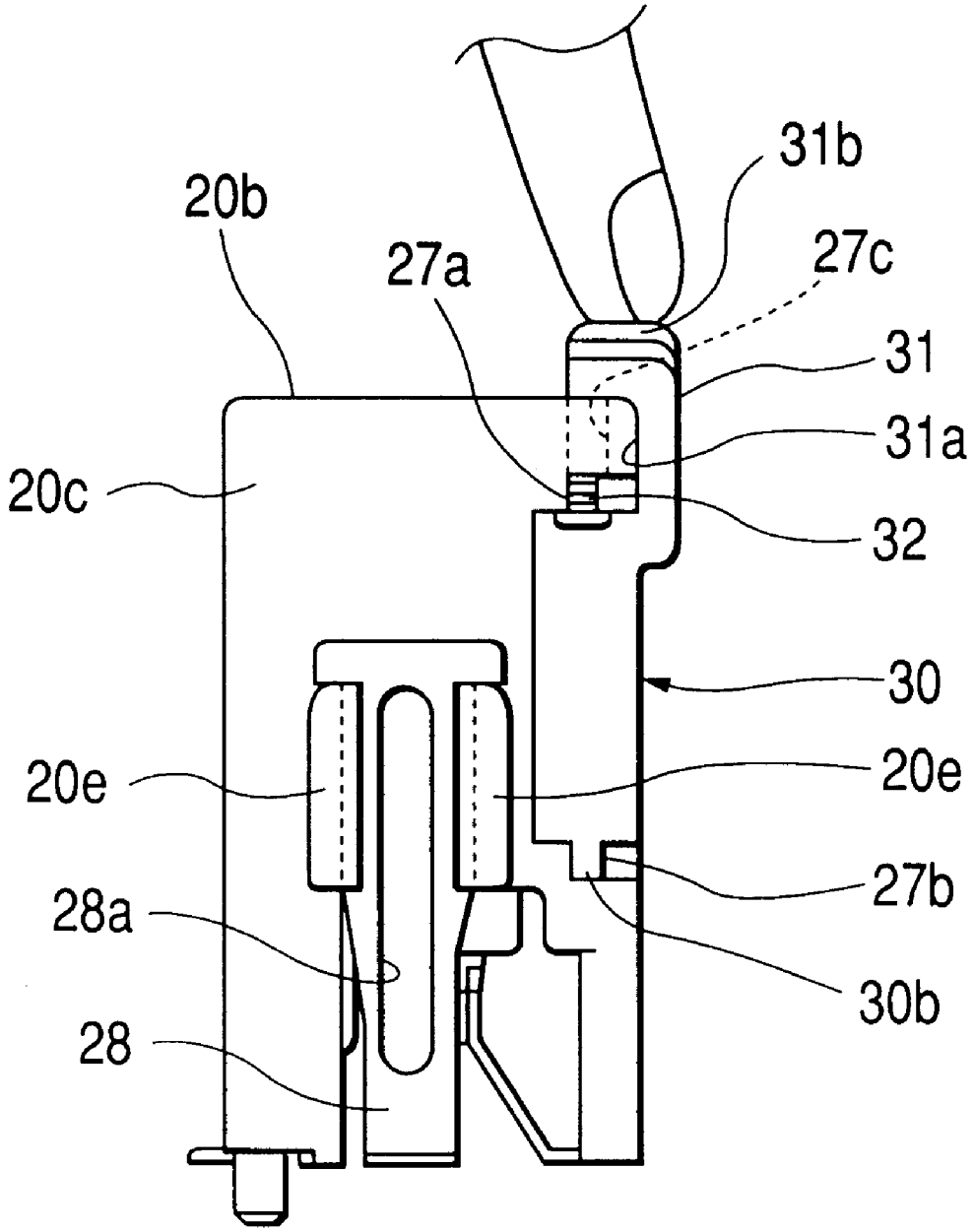
FIG. 3 is a side-elevational view of the female connector housing.
Figure 4:
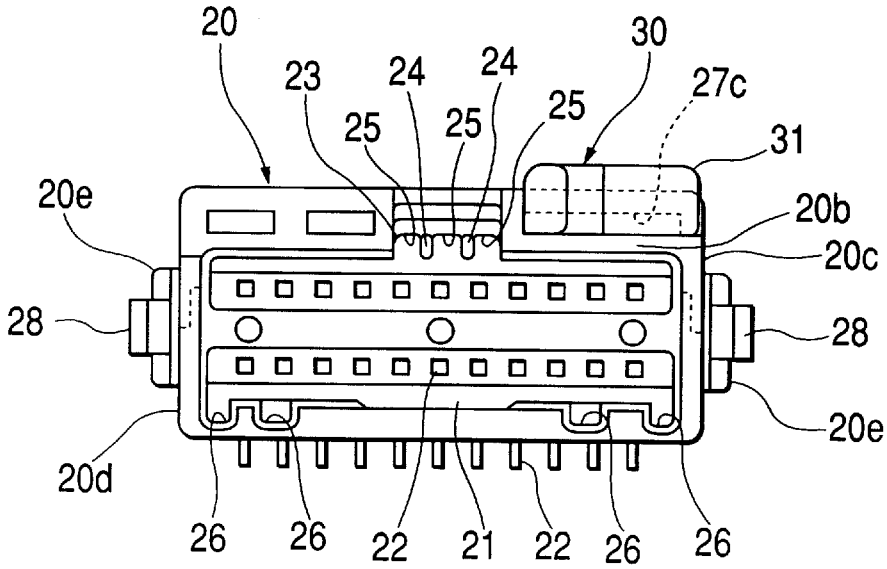
FIG. 4 is a front-elevational view of the female connector housing.
Figure 5:
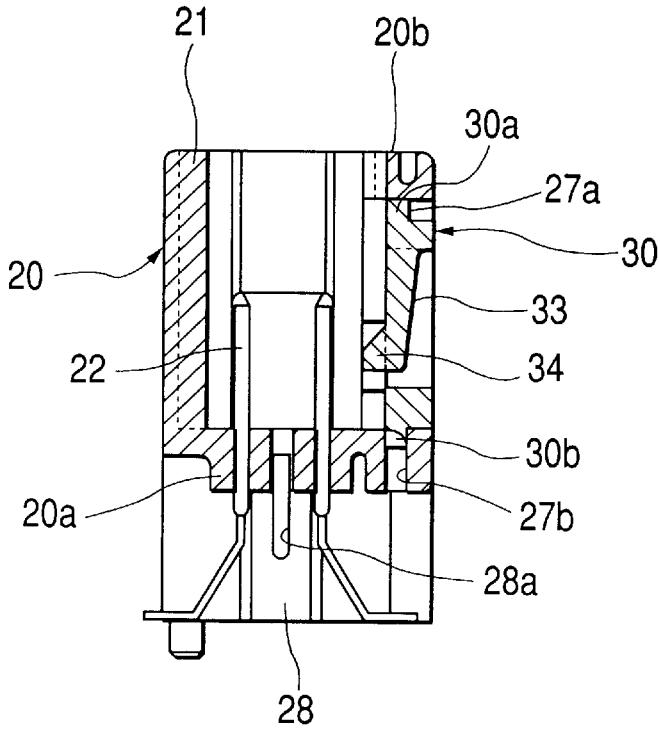
FIG. 5 is a cross-sectional view of the female connector housing.

As shown in FIG. 2, a rectangular opening 27 is formed in the plane surface of the female connector housing 20, and a pair of channel-shaped guide grooves 27*a* and 27*b* are formed respectively in upper and lower edges of the opening 27. A guide groove 27*c* of a square, tubular shape is formed at the upper side (that is, the upper left side in FIG. 2) of one end of the upper guide groove 27*a*, and communicates with this guide groove 27*a*. An engagement recess (engagement portion) 27*d* of an inverted triangular shape is formed at a central portion of the lower guide groove 27*b*. Left and right side surfaces 20*c* and 20*d* of the female connector housing 20 are equal in length to the male tab terminal 22, and extend downwardly, and a pair of bracket portions 20*e* and 20*e* are integrally formed on and project from a central portion of each of these side surfaces 20*c* and 20*d*. A fixing metal member 28, which is in the form of an L-shaped plate, and has a central slot 28*a*, is supported by the pair of bracket portions 20*e* and 20*e* for upward and downward movement.

Figure 7A:
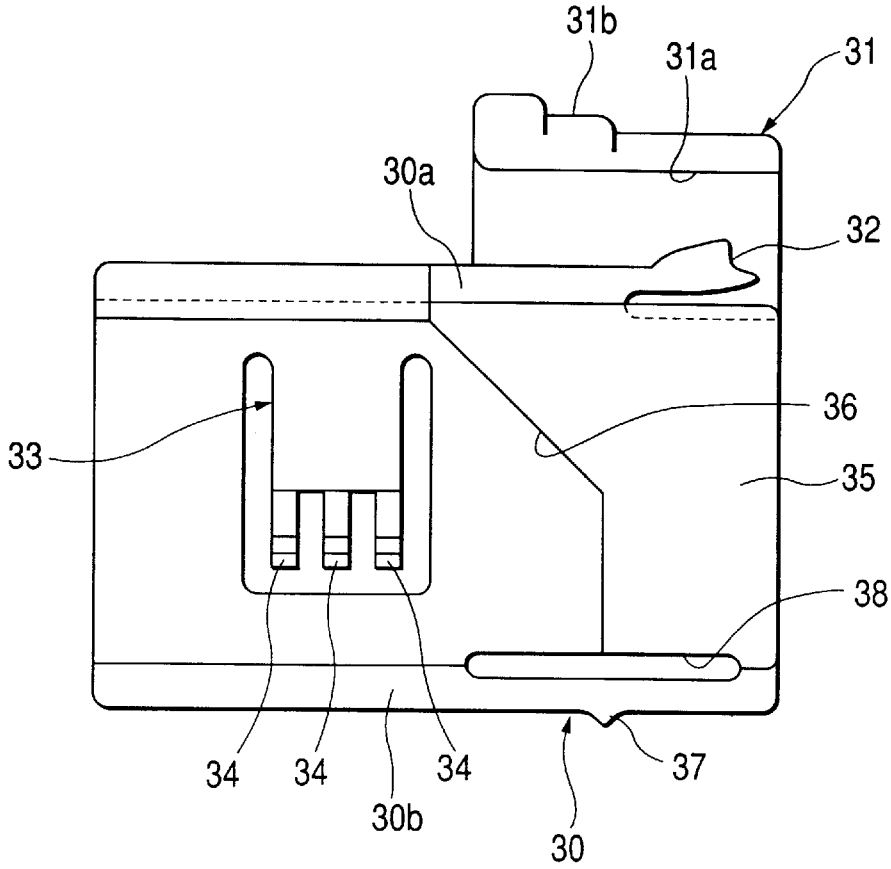
FIG. 7(*a*) is a view of a slide member to be mounted on the female connector housing, as seen from the inside.
Figure 7B:
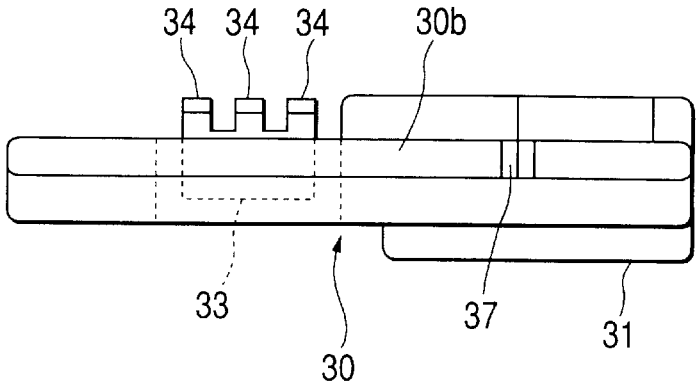
Figure 8:
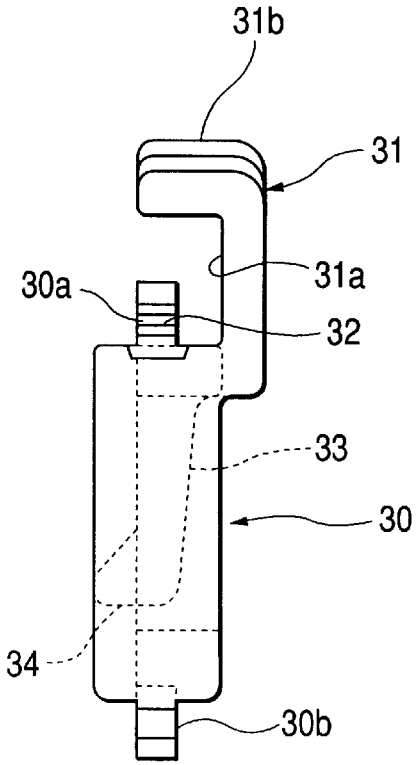
FIG. 8 is a side-elevational view of the slide member.

As shown in FIGS. 2, 7 and 8, the slide member 30 is made of a synthetic resin, and is formed into a generally rectangular plate. Rails portions 30*a* and 30*b* are formed respectively on upper and lower end surfaces of the slide member 30, and are disposed generally centrally of the thickness thereof, and these rail portions 30*a* and 30*b* are slidably supported in the upper and lower guide grooves 27*a* and 27*b* of the opening 27 of the female connector housing 20. The operating portion 31 of an U-shaped cross-section is integrally formed with the slide member 30, and is disposed adjacent to a left end portion (FIG. 2) of the upper rail portion 30*a*. A guide groove 31*a* is formed in the operating portion 31, and this guide groove 31*a* supports an operating (pushing) force, applied to the operating portion 31, through an upper end surface (one surface) 20*b* and the plane surface of the female connector housing 20. This guide groove 31*a* of a channel-shape is slid along the upper end surface 20*b* and the plane surface of the female connector housing 20. A withdrawal-prevention retaining projection 32 (which is part of the upper rail portion 30*a* ) is integrally formed on and projects from a lower surface of the guide groove 31*a* in the operating portion 31, and is disposed generally centrally of the width of this lower surface, and this retaining projection 32 is inserted in the tubular guide groove 27*c* (formed in the female connector housing 20*b* in adjacent relation to the upper end surface 20*b* thereof) against withdrawal.

An elastic lock arm 33 is formed at a generally central portion of the slide member 30 through a U-shaped notch. The three elastic retaining projections 34, corresponding in number to the engagement projections 11, are formed at a distal end of the lock arm 33. That portion of the slide member 30, disposed between the withdrawal-prevention retaining projection 32 and the lock arm 33, is greater in thickness than the other portion thereof, and this thickened portion 35 has a connector-fitting slanting surface 36 which is disposed close to the lock arm 33, and is inclined at an angle of about 45 degrees. When the slide member 30 is moved, the slanting surface 36 is brought into engagement with the engagement projection 11 of the male connector housing 10, thereby fitting the male connector housing 10 into the hood portion 21 of the female connector housing 20.

A retaining projection (retaining portion) 37 of a triangular shape is formed integrally on that surface of the lower rail portion 30*b* of the slide member 30 facing away from the operating portion 31, and this retaining projection 37 can be brought into and out of engagement in the engagement recess 27*d* in the female connector housing 20. That portion, including the retaining projection 37, can be elastically deformed through a slot 38 formed parallel to the lower rail portion 30*b*. An upper surface of the operating portion 31 of the slide member 30 is stepped to provide an operating surface 31*b*.

The fitting operation of the above connector locking construction will not be described. When the male connector housing 10 is inserted into the hood portion 21 of the female connector housing 20 as shown in FIG. 1, the engagement projections 11 of the male connector housing 10 are inserted respectively into the passage grooves 25 in the hood portion 21.

Figure 9A:
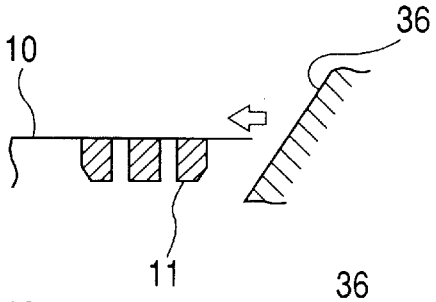
FIGS. 9(*a*), 9(*b*) and 9(*c*) are respectively a view showing a condition before the engagement of an engagement projection of the male connector housing with a connector-fitting slanting surface of the slide member is achieved, a view showing a condition when this engagement is achieved, and a view showing a condition after this engagement.
Figure 9B:
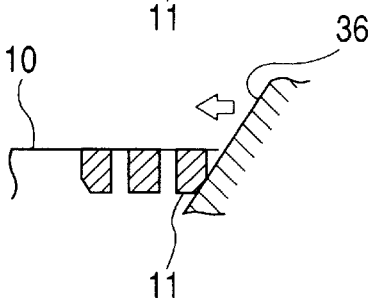
Figure 9C:
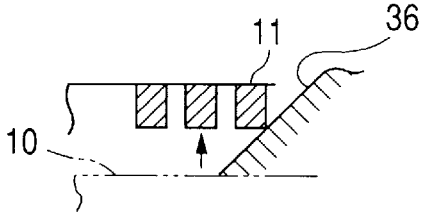

Then, when the operating portion 31 of the slide member 30 is operated or pushed toward the right side surface 20*d* of the female connector housing 20, the connector-fitting slanting surface 36 of the slide member 30 is brought into engagement with the engagement projection 11 of the male connector housing 10 as shown in FIGS. 9(*a*) to 9(*c*), so that the male connector housing 10 is drawn toward the female connector housing 20, and is fitted into the hood portion 21. Thus, when the operating portion 31 of the slide member 30 is pushed, the connector-fitting slanting surface 36 of the slide member 30 is brought into engagement with the engagement projection 11 of the male connector housing 10, so that the male connector housing 10 is smoothly fitted into the hood portion 21 of the female connector housing 20, and therefore, for example, when fitting the male connector housing 10 into the female connector housing 20 having the male tab terminals 22 soldered to a board 40, a stress or a crack will not develop in each solder portion 41 connecting the male tab terminal 22 to the board 40.

Figure 10A:
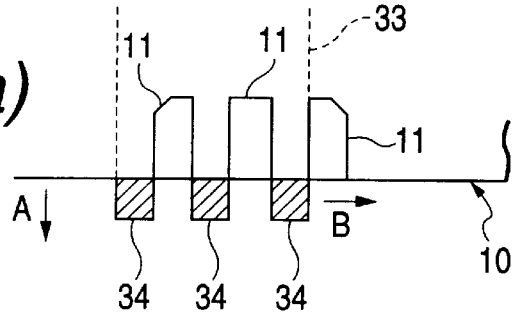
FIGS. 10(*a*) and 10(*b*) are respectively a view showing a condition before the engagement projections of the male connector housing are engaged respectively with elastic retaining projections of the slide member, and a view showing a condition after this engagement.
Figure 10B:
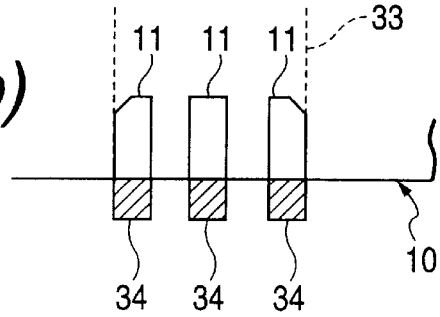
Figure 11:
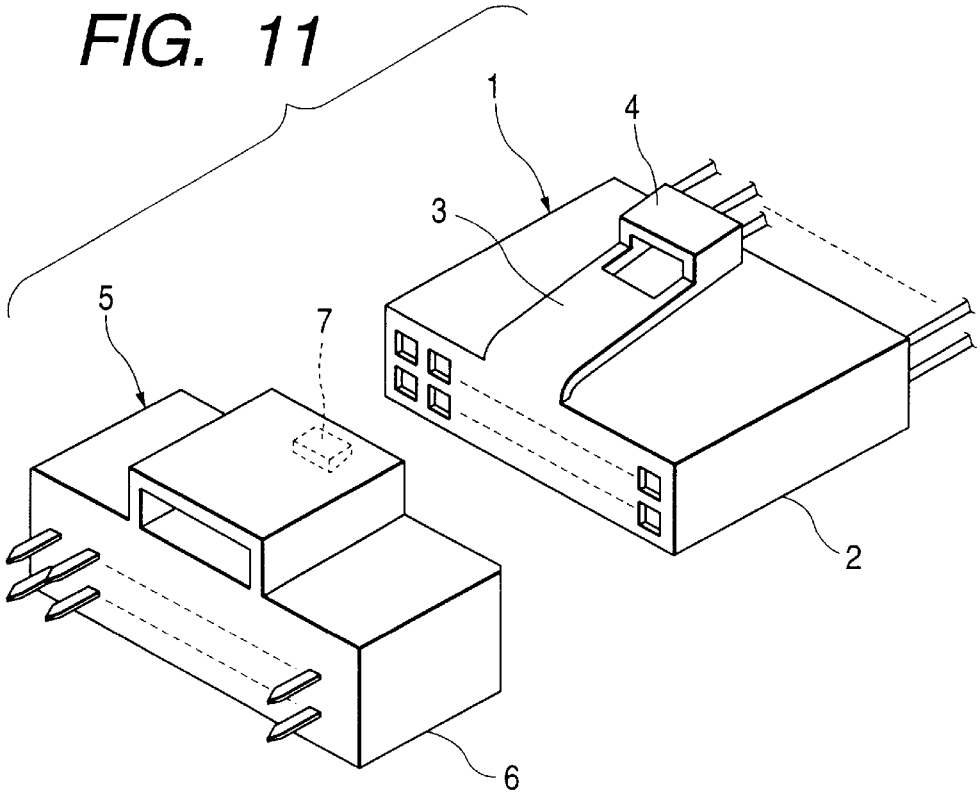
FIG. 11 is an exploded, perspective view of a conventional construction.

As shown in FIG. 1, when the male connector housing 10 is fitted into the female connector housing 20, the three engagement projections 11 of the male connector housing 10 pass respectively through the passage grooves 25 in the hood portion 21 of the female connector housing 20, and the movement of the engagement projections 11 is guided by the pair of guide ribs 24 forming the passage grooves 25, and therefore the male connector housing 10 smoothly moves linearly relative to the female connector housing 20. Therefore, the two connector housings 10 and 20 are fitted together easily and positively, and the male tab terminals 22 of the female connector housing 20 will not be forcibly deformed. At an initial stage of the fitting connection between the two connector housings 10 and 20, each of the three engagement projections 11 of the male connector housing 10 is disposed between the corresponding ones of the three elastic retaining projections 34 of the lock arm 33 of the slide member 30 as shown in FIG. 10(*a*), and therefore the male connector housing 10 is smoothly fitted into the hood portion 21 of the female connector housing 20, and at the time when the two connector housings 10 and 20 are fitted together by pushing the slide member 30, the three engagement projections 11 of the male connector housing 10 are engaged or locked respectively by the elastic retaining projections 34 of the lock arm 33, as shown in FIG. 10(*b*). For canceling this locked condition, the slide member 30 is moved in a direction opposite to a direction of arrow B (FIG. 10(*a*)) by an amount equal to the width of one engagement projection 11, and by doing so, the locked condition is canceled. With this construction, the locking strength is obtained, and also the distance of movement of the slide member 30 when canceling the locked condition is shortened. Namely, a space, required for the movement of the slide member 30, is small, and the overall size of the connector can be reduced.

When the operating portion 31 of the slide member 30 is operated or pushed, this operating (pushing) force of the operating portion 31 is supported mainly by the upper end surface 20*b* of the female connector housing 20 through the guide groove 31*a* in the operating portion 31, and therefore the slide member 30 can be smoothly moved without receiving a force tending to rotate the slide member 30. Particularly, the guide groove 31*a* in the operating portion 31 has a channel-shape, and therefore the slide member 31 can smoothly slide along the upper end surface 20*b* of the female connector housing 20 without rattling. The withdrawal-prevention retaining projection 32 is formed at the lower surface of the guide groove 31*a* in the operating portion 31, and therefore the slide member 30 is prevented from being disengaged from the upper end surface 20*b* of the female connector housing 20, and further since the withdrawal-prevention retaining projection 32 is inserted in the guide groove 27*c* of a square, tubular shape formed in the female connector housing 20 in adjacent relation to the upper end surface 20*b* thereof, the shaking of the slide member 30 in a rotational direction is positively prevented, and the slide member 30 can be operated smoothly.

The connector locking construction of this embodiment has been described above, and in the present invention, the connector-fitting slanting surface is formed on the slide member, and the slide member is moved to bring the connector-fitting slanting surface into engagement with the engagement projection of the male connector housing, thereby automatically fitting the male connector housing into the hood portion of the female connector housing. A connector-disengaging slanting surface may further be formed on the slide member, in which case the slide member is moved to bring this connector-disengaging slanting surface into engagement with the engagement projection of the male connector housing, thereby automatically disengaging the male connector from the hood portion of the female connector housing.

As described above, in the present invention, an operating pushing force, applied to the operating portion of the slide member when pushing this operating portion, is supported at least by one surface of the female connector housing through the guide groove, and therefore there is achieved an advantage that the slide member is smoothly moved without receiving a force tending to rotate the slide member.

In the present invention, the guide groove has a channel-shape, and therefore there is achieved an advantage that the slide member is smoothly moved along the upper end surface of the female connector housing without rattling.

In the present invention, the withdrawal-prevention retaining projection is provided at the guide groove in the operating portion of the slide member, and therefore there is achieved an advantage that the slide member will not be disengaged from the upper end surface of the female connector housing.

In the present invention, the withdrawal-prevention retaining projection is inserted in the guide groove formed in the female connector housing in adjacent relation to the upper end surface of the female connector housing, and therefore there is achieved an advantage that the shaking of the slide member in rotational and other directions is positively prevented, and the slide member can be operated smoothly.

What is claimed is:

1. A connector locking construction comprising:

a male connector housing on which engagement projections are formed;

a female connector housing having a hood portion in which passage grooves are formed, said hood portion adapted to receive said male connector housing, such that said engagement projections pass through said passage grooves; and a slide member having elastic retaining projections for engagement with said engagement projections to retain said male and said female connector housings in a locked together condition, said slide member movably mounted on said hood portion;

wherein said slide member is provided with a guide groove that is slidable along a surface of said female connector housing; and wherein said slide member is slidable in a direction that is perpendicular to an insertion direction along which said male connector housing is insertable into said hood portion of said female connector housing.

2. A connector locking construction according to claim 1, in which said guide groove has a channel-shape, and said channel-shaped guide groove is slidable at least along an upper end surface of said female connector housing.

3. A connector locking construction according to claim 1, in which said guide groove is provided with a withdrawal-prevention retaining projection.

4. A connector locking construction according to claim 1, in which the engagement of said elastic retaining projections with said engagement projections prevents said male connector housing from being removed from said female connector housing.

5. A connector locking construction comprising:

a male connector housing on which an engagement projection is formed;

a female connector housing having a hood portion in which a passage groove is formed, said hood portion adapted to receive said male connector housing, such that said engagement projection passes through said passage groove; and a slide member having an elastic retaining projection for engagement with said engagement projection, said slide member movable mounted on said hood portion;

wherein said slide member is provided with a guide groove that is slidable along a surface of said female connector housing;

wherein said slide member is slidable in a direction that is perpendicular to an insertion direction along which said male connector housing is insertable into said hood portion of said female connector housing;

wherein said guide groove is provided with a withdrawal-prevention retaining projection; and wherein said female connector housing is provided with a retaining groove that receives said withdrawal-prevention retaining projection.

6. A connector locking construction comprising:

a male connector housing on which an engagement projection is formed;

a female connector housing having a hood portion in which a passage groove is formed, said hood portion adapted to receive said male connector housing, such that said engagement projection passes through said passage groove; and a slide member having an elastic retaining projection for engagement with said engagement projection, said slide member movable mounted on said hood portion;

wherein said slide member is provided with a guide groove that is slidable along a surface of said female connector housing;

wherein said slide member is slidable in a direction that is perpendicular to an insertion direction along which said male connector housing is insertable into said hood portion of said female connector housing; and wherein said slide member has an operating portion, and said guide groove is provided in said operating portion.

* * * * *